United States Patent [19]

Maeda

[11] Patent Number: 4,574,580

[45] Date of Patent: Mar. 11, 1986

[54] NIP TYPE FALSE TWISTING APPARATUS

[75] Inventor: Yoshiyasu Maeda, Nara, Japan

[73] Assignee: Murata Kikai Kabushiki Kaisha, Japan

[21] Appl. No.: 589,139

[22] Filed: Mar. 13, 1984

[30] Foreign Application Priority Data

Mar. 16, 1983 [JP] Japan ..... 58-45204

[51] Int. Cl.[4] ..... D02G 1/04; D01H 7/92

[52] U.S. Cl. ..... 57/336

[58] Field of Search ..... 57/336

[56] References Cited

U.S. PATENT DOCUMENTS

| | | | |
|---|---|---|---|
| 3,938,399 | 2/1976 | Delfiol et al. | 57/336 |
| 4,047,373 | 9/1977 | Takai | 57/336 |
| 4,248,038 | 2/1981 | Takai | 57/336 |

*Primary Examiner*—Donald Watkins

*Attorney, Agent, or Firm*—Spensley Horn Jubas & Lubitz

[57] ABSTRACT

In a nip type false twisting apparatus for false twisting a yarn nipped between two endless belts intersecting each other and running in the opposite directions, the belt is formed of a relatively soft material which is selected to have resilient elasticity in a determined range and is used under the low contact pressure.

3 Claims, 6 Drawing Figures

NIP TYPE FALSE TWISTING APPARATUS

FIELD OF THE INVENTION

The present invention relates to a apparatus for false twisting a yarn by the use of a nip type false twisting apparatus.

SUMMARY OF THE INVENTION

An object of the present invention is to propose a false twisting apparatus which can ensure the high false twisting efficiency with the contact pressure between the belts in a relative low level.

Further object is to propose a false twisting apparatus which allows less belt abrasion. According to the present invention, the belt is formed of a relatively soft material, i.e., selected to have resilient elasticity in a range of 30–55%, and it is used under the contact pressure of 100–250 g. Whereby, it becomes possible to increase the grasping force of the belts against the yarn and to nip the same yarn with the contact pressure between the belts lower than that in the prior art.

DETAILED DESCRIPTION OF THE INVENTION

Figure 1:
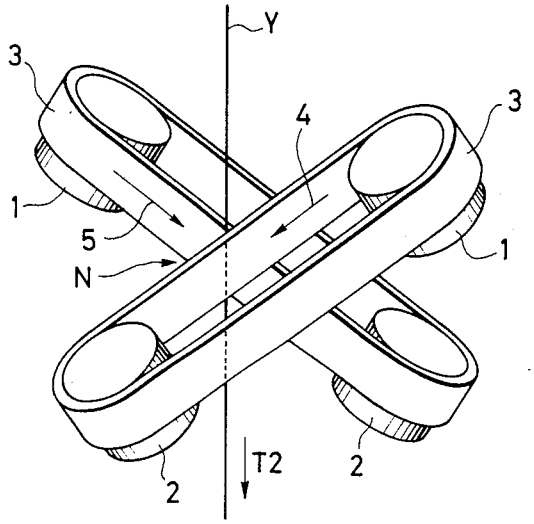
FIG. 1 is a view schematically showing a nip type false twisting apparatus.

As shown in FIG. 1, a nip type false twisting apparatus of this kind includes endless belts 3, 3 which are stretched between drive pulleys 1, 1 and driven pulleys 2, 2. The belts 3, 3 run in the directions of arrows 4, 5 while nipping a yarn Y therebetween, respectively, to apply false twisting to the yarn Y.

Figure 2:
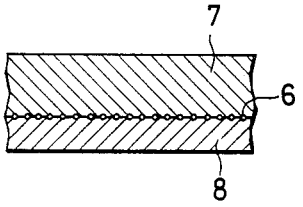
FIG. 2 is a view showing a section of a belt.

Each of the belts 3, 3 has a sectional structure as shown in FIG. 2. That is, a front side rubber layer 7 contacting with the yarn Y and a rear side rubber layer 8 not contacting with the yarn Y are bonded to each other through core cords 6 formed of threads, canvas, etc.

Figure 3:
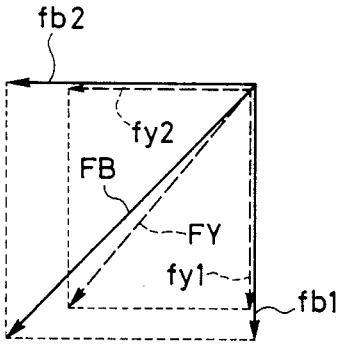
FIG. 3 is a view for explaining the action of forces in the false twisting apparatus of FIG. 1.

The nipping type false twisting apparatus is featured in that the running force of the belt 3, 3 is divided into a feeding component fb1 for the yarn Y and a twisting component fb2 during the action of false twisting, as shown in FIG. 3. However, since there occurs a slippage between the belt 3 and the yarn Y, the magnitude of the force that the yarn Y receives actually is decreased as indicated by a symbol FY. In particular, it is known that transmission of the twisting component fb2 becomes inadequate.

Such inadequate transmission reduces the number of twists of the yarn Y and results in reduction of the yarn quality. As means for preventing that, it has been proposed to increase the contact pressure between the belts 3 and 3 for nipping the yarn Y firmly and, hence, to restrict slippage of the yarn Y. In practice, this method has been adopted widely.

The increased contact pressure between the belts, however, necessarily leads to the fact that the belts 3, 3 contact with each other directly intensely and abrasion of the belts is intensified. From this reason, attempts for improvement in the art has been mainly directed to development of belts with higher abrasion resistance hereinbefore.

The present invention has been proposed in view of the forgoing situation and has succeeded in development of a false twisting method which can insure the high false twisting efficiency with the contact pressure between the belts in a relatively low level, and hence which allows less belt abrasion.

Figure 4:
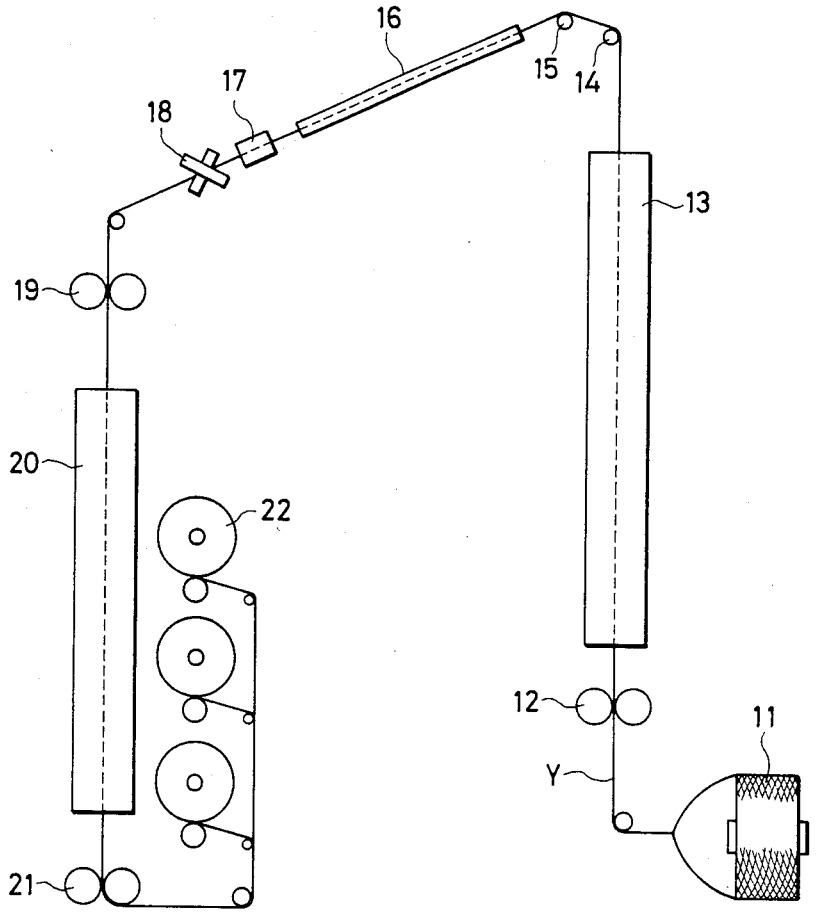
FIG. 4 is a view showing one example a yarn false twisting machine using the method of this invention.

One example of a yarn false twisting machine to which the method of the present invention is applied, is schematically shown in FIG. 4.

A yarn Y drawn out from a yarn feeding package 11 through a first pair of feed rollers 12 is lifted up while passing through a heater 13, then goes through a balloon control plate 16 via deflecting rollers 14, 15 and then enters a yarn cooling unit 17 where the yarn is cooled down to the preset temperature. Thereafter, the yarn is introduced into a nipping type false twisting apparatus 18 as mentioned above, and then positively sent out through a second pair of feed rollers 19.

The yarn Y is adequately elongated between the two pairs of feed rollers 12, 19 and also subjected to the action of false twisting in the temporary twisting apparatus 18. Twisting of the yarn formed in the false twisting apparatus 18 is propagated up to the first pair of feed rollers 12 so as to be brought under thermal treatment by the heater 13.

The yarn Y thus false twisted is subjected to thermal treatment in a second heater 20 again, as required, then drawn out by a third pair of feed rollers 21 and finally rolled up by one of take-up packages 22.

Graphs of FIG. 5 show the experimental results of the yarn false twisting machine as mentioned above in case of using various belts 3. The meaning of such results will be described below.

As previously noted, the increased magnitude of the feeding component fy1 in FIG. 3 that the yarn Y receives actually means the fact that the twisting component fy2 becomes larger and the false twisting efficiency is improved, and further the fact that the tension T2 of the yarn Y just after passing the nipped point N becomes smaller.

Figure 5A:
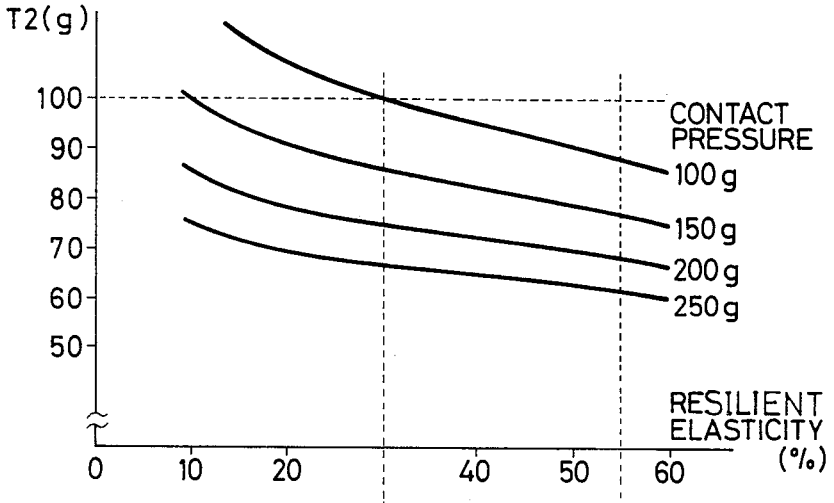
FIG. 5*a* is a graph showing the relationship between the resilient elasticity of front side rubber layer of the belt and the yarn tension.

Therefore, the smaller yarn tension T2 presents the better false twisting efficiency. FIG. 5*a* denotes the relationship between the yarn tension T2 and the resilient elasticity of front side rubber layer 7 of the belt 3, while FIG. 5*b* denotes the relationship between the abrasion amount of the front side rubber layer 7 and the resilient elasticity thereof.

It is here assumed that the resilient elasticity is specified by JIS (Japanese Industrial Standard) as an index for indicating characteristics of rubber or the like, and that definition and measuring technique of the resilient elasticity are conformed to JIS.

Figure 5B:
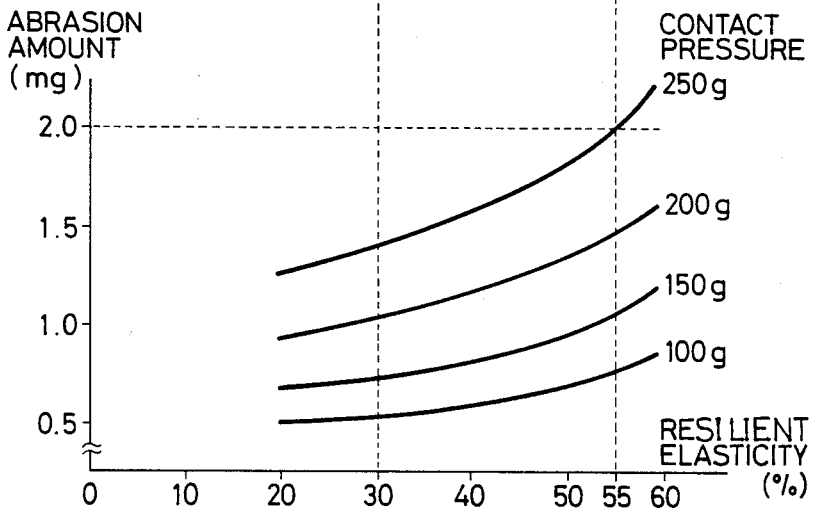
FIG. 5*b* is a graph showing the between the resilient elasticity thereof and the abrasion amount of belt.

The yarn Y used in the experiment from which are obtained the graphs of FIG. 5*a* and 5*b* was a very typical one, i.e., a polyester non-elongated yarn formed of 48 filaments and having 225 den before elongation and 150 den after elongation. The yarn speed was set at 600 m/min, the elongation ratio at 1.53 and the crossing angle of belts of the false twisting apparatus 18 was set at 115°.

A high-nitril endless belt with a width of 8 mm and a circumferential length of 230 mm was used for each of the belts 3, 3. The aforesaid abrasion amount of belt is represented by weight (grams) of the worn rubber corresponding to abrasion occurred in the belt 3 under the foregoing conditions per hour.

It is to be noted that the illustrated graphs are ones which were plotted in accordance with the data resulted from a number of experiments so as to represent the general tendency. It has been confirmed that, although some of the data slightly deviate from the curves in the illustrated graphs or different experimental conditions offer some plots slightly different from the illustrated ones, those data are not largely deviated from the characteristics represented by the graphs and show the substantially same tendency.

Such a tendency will be found from the graphs that, as the resilient elasticity of the front side rubber layer 7 is increased, the yarn tension T2 is decreased but the abrasion amount of belt is increased.

The following will be also apparent. With the resilient elasticity set at 30%, the yarn tension T2 reaches the later-described upper limit value of 100 g at the interbelt contact pressure of 100 g. Further, with the resilient elasticity set at 55 %, the abrasion amount of belt reaches the upper limit value of 2.0 mg at the interbelt contact pressure of 250 g. In other words, when the resilient elasticity is set at 30–55%, both yarn tension T2 and abrasion amount of belt locate within an allowable range with the interbelt contact pressure in a range of 100–250 g.

The above range of 100–250 g for the interbelt contact pressure is one which is generally used in the nip type false twisting apparatus. If out of this range, vibrations of the belts 3, 3 are enlarged to cause significant fluctuations in twisting, or the yarn Y may be cut off as a result of the excess force applied thereto. Thus, the contact pressure out of the above range is regarded as not preferable except for the special cases.

On the other hand, the above limit value of 100 g in the yarn tension T2 is a limit value which can positively ensure application of false twisting to the yarn Y. The upper limit value of the abrasion amount of belt, i.e., 2.0 mg/hour is a value which is regarded as a practical limit in the point of maintenance for the false twisting apparatus.

It will be further apparent from FIG. 5*a* that the method of the present invention permits false twisting under the relatively low contact pressure between the belts.

More specifically, there has been generally used the belt 3 with low resilient elasticity. For example, if the value of resilient elasticity is set at 10%, the interbelt contact pressure can not be made less than 150 g. In contrast with this, it will be readily found that, if the value of resilient elasticity is set at, for example, 30% in accordance with the present invention, the interbelt contact pressure can be lowered down to 100 g. Other examples of experiment produced the result as follows. False twisting for a yarn effected by the use of the conventional belt 3 required the interbelt contact pressure of 240 g for a yarn of 150 den and that of 220 g for a yarn of 75 den. Meanwhile, when false twisting was effected by the use of the belt having the front side rubber layer 7 formed of a rubber material with resilient elasticity of 31 % falling in a range of the present invention, the interbelt contact pressure of 150–180 g and 130–160 g was enough for a yarn of 150 den and 75 den, respectively.

In the present invention, components of the front side rubber layer 7 is not limited to special ones, and nitril or urethane rubber may be used optionally.

It is preferable for the front side rubber layer 7 to have a greater thickness relative to the rear side rubber layer 8. There is no limitation on characteristics of the rear side rubber layer 8.

According to the method of the present invention, as fully described in the above, the good false twisting efficiency can be secured under the lower contact pressure between the belts and high quality yarns can be produced steadily.

What is claimed is:

1. A nip type false twisting apparatus for false twisting a yarn nipped between the two endless belts intersecting each other in contact relationship along respective surfaces thereof, said surfaces being in contact under a pressure of 100 g to 250 g, said apparatus comprising: a rubber layer covering said intersecting sufaces of each of said belts, said layer having a resilient elasticity of 30% to 55%, whereby tension on said yarn is maintained below 100 g and the amount of belt abrasion is maintained below 2.0 mg.

2. The apparatus as claimed in claim 1, wherein said rubber layer is made of nitril rubber.

3. The apparatus as claimed in claim 1, wherein said rubber layer is made of urethane rubber.

* * * * *